US008161600B2

(12) United States Patent
Kwon

(10) Patent No.: US 8,161,600 B2
(45) Date of Patent: Apr. 24, 2012

(54) DUST COLLECTING PIPE FOR VACUUM CLEANER

(76) Inventor: Young-Doo Kwon, Daegu (KR)

( * ) Notice: Subject to any disclaimer, the term of this patent is extended or adjusted under 35 U.S.C. 154(b) by 95 days.

(21) Appl. No.: 12/575,228

(22) Filed: Oct. 7, 2009

(65) Prior Publication Data

US 2010/0088845 A1 Apr. 15, 2010

(30) Foreign Application Priority Data

Oct. 14, 2008 (KR) ..... 20-2008-0013699 U
Mar. 6, 2009 (KR) ..... 20-2009-0002546 U

(51) Int. Cl.
*A47L 9/02* (2006.01)

(52) U.S. Cl. ..... 15/416; 15/420; 15/422

(58) Field of Classification Search ..... 15/415.1, 15/414, 416–422, 422.1, 393, 365, 367, 375, 15/324, 322, 310, 402, 410, 398, 401
See application file for complete search history.

(56) References Cited

U.S. PATENT DOCUMENTS 1,597,855 A * 8/1926 Zahorsky ..... 15/400
2,028,847 A * 1/1936 Ricks et al. ..... 15/417
2,101,222 A * 12/1937 Mccracken ..... 15/398
2,780,829 A * 2/1957 Cohen ..... 15/365
2,908,933 A * 10/1959 Todd, Jr. et al. ..... 15/414
4,204,328 A * 5/1980 Kutner ..... 433/29
6,026,541 A * 2/2000 Bailey et al. ..... 15/414
6,044,521 A * 4/2000 Sebek ..... 15/393
6,921,438 B2 * 7/2005 Lausevic ..... 134/21
2004/0098829 A1 * 5/2004 Song ..... 15/400
2008/0163451 A1 * 7/2008 Buller et al. ..... 15/414

FOREIGN PATENT DOCUMENTS

JP 3034892 12/1996
JP 2000-126097 A 5/2000
KR 1020070018714 A 2/2007

* cited by examiner

*Primary Examiner* — Dung Van Nguyen
(74) *Attorney, Agent, or Firm* — Reinhart Boerner Van Deuren P.C.

(57) ABSTRACT

A dust-collecting pipe for a vacuum cleaner can efficiently and easily clean an area such as the top surface of a wardrobe, an area under the wardrobe, or a heat radiator of a refrigerator, which are not easily reachable by the suction port of the dust-collecting pipe. The dust-collecting pipe includes a coupling part detachably coupled to a front end of a telescopic pipe or a front end of a control handle of the vacuum cleaner; an extension integrally extending from the coupling part; and a suction part having a bent portion angled in one direction from one end of the extension and a hollow dust-collecting port formed in a terminal end of the suction part.

16 Claims, 9 Drawing Sheets

DUST COLLECTING PIPE FOR VACUUM CLEANER

CROSS REFERENCE TO RELATED APPLICATION

The present application claims priority to Korean Patent Application Number 20-2008-0013699 filed on Oct. 14, 2008 and to Korean Patent Application Number 20-2009-0002546 filed on Mar. 6, 2009, which claims priority to Korean Patent Application Number 20-2008-0013699, the entire contents of which application are incorporated herein for all purposes by this reference.

BACKGROUND OF THE INVENTION

1. Field of the Invention

The present invention relates to a dust-collecting pipe for a vacuum cleaner and, more particularly, to a dust-collecting pipe for a vacuum cleaner capable of efficiently and easily cleaning an area such as the top surface of a wardrobe, an area under the wardrobe, or a heat radiator of a refrigerator, which are not easily cleaned by the suction port of the dust-collecting pipe.

2. Description of the Related Art

A vacuum cleaner is typically a cleaning device which sucks up dust or other particulate matters from flat surfaces using a draft of air created by the actuation of a fan motor.

Among the accompanying drawings, FIG. 1 is a schematic configuration view illustrating a conventional vacuum cleaner. Referring to FIG. 1, the vacuum cleaner includes a body 10, a flexible hose 20, a control handle 30, a telescopic pipe 40, and a brush 50. The body 10 has a dust container (not shown) mounted inside or outside, which sucks in and collects dust or particulate matters using an absorbing force created by the actuation of a fan motor (not shown). The flexible hose 20 is connected to a suction port on the body 10 and guides drawn-in particulate matters to be collected to the dust container of the body 10. The control handle 30 is coupled to one end of the flexible hose 20 and is used to adjust the absorbing force by controlling the fan motor. The telescopic pipe 40 is coupled to one end of the control handle 30 opposite to the flexible hose 20 and is adjustable in length by the user. The brush 50 is detachably coupled to one end of the telescopic pipe 40 opposite to the control handle 30.

The brush 50 is typically pipe-connected to the terminal end of the telescopic pipe 40. A flat surface such as a floor can be properly cleaned using the brush 50. However, since the telescopic pipe 40 is made of a rigid material, the volume of the telescopic pipe 40 and the brush 50 make it difficult to properly place the brush 50 on an area to be cleaned such as the top surface of a wardrobe or an area under the wardrobe when attempting to suck in dust therefrom.

A large amount of dust (e.g., at a thickness of about 1 to 1.5 cm) may accumulate on top of a heat radiator of an electric appliance such as a refrigerator as the most commonly used model is changing from the one-story vertical type to the multi-story horizontal type. This significantly lowers the heat efficiency of the refrigerator, with a potential danger of fire due to dust or the like. Accordingly, there are demands for a novel structure of a telescopic pipe and brush capable of cleaning heat radiators of refrigerators.

The information disclosed in this Background of the Invention section is only for enhancement of understanding of the background of the invention and should not be taken as an acknowledgment or any form of suggestion that this information forms the prior art that is already known to a person skilled in the art.

BRIEF SUMMARY OF THE INVENTION

Various aspects of the present invention provide a dust-collecting pipe for a vacuum cleaner that has a slot-shaped suction port and an elongated connecting pipe and thus can efficiently and easily remove dust or particulate matters from an area such as the top surface of a wardrobe or an area under the wardrobe.

There is provided a dust-collecting pipe for a vacuum cleaner that has an elongated connecting pipe and thus can efficiently and easily remove dust or particulate matters from a heat radiator of a refrigerator.

In an aspect of the invention, the dust-collecting pipe for a vacuum cleaner may include a coupling part detachably coupled to a front end of a telescopic pipe or a front end of a control handle of the vacuum cleaner; an extension integrally extending from the coupling part; and a suction part having a bent portion angled in one direction from one end of the extension and a hollow dust-collecting port formed in a terminal end of the suction part.

The bent portion may have a plurality of indents formed along a circumference of a terminal end thereof, in which the indents are recessed to a predetermined depth toward the dust-collecting port such that the dust-collecting port communicates with an outside through the indents when the terminal end of the bent portion is in contact with a flat surface.

The dust-collecting pipe may further include a brush or a rubber tip detachably coupled to the dust-collecting port of the suction part.

The rubber tip may have a waved uneven bottom.

The dust-collecting port may have a stepped portion with an inner diameter smaller than those of the other portions of the dust-collecting port.

The dust-collecting port may have a circular or polygonal configuration.

The extension may have a length ranging from 60 cm to 90 cm.

In another aspect of the invention, the dust-collecting pipe for a vacuum cleaner may include a coupling part detachably coupled to a front end of a telescopic pipe or a front end of a control handle of the vacuum cleaner; an extension integrally extending from the coupling part; and a suction part having a pair of bent portions branched off from one end of the extension at predetermined angles, wherein the bent portions extend in opposite directions from each other, and hollow dust-collecting ports each formed in a terminal end of a corresponding one of the suction parts.

The bent portion may have a plurality of indents formed along a circumference of a terminal end thereof, in which the indents are recessed to a predetermined depth toward the dust-collecting port such that the dust-collecting port communicates with an outside through the indents when the terminal end of the bent portion is in contact with a flat surface.

The dust-collecting pipe may further include a brush or rubber tip detachably coupled to the dust-collecting port of the suction part.

The rubber tip may have a waved uneven bottom.

The dust-collecting port may have a stepped portion with an inner diameter smaller than those of the other portions of the dust-collecting port.

The dust-collecting port may have a circular or polygonal configuration.

The extension may have a length ranging from 60 cm to 90 cm.

The dust-collecting pipe may further include a closer selectively provided in one of the dust-collecting ports to close the dust-collecting port.

In a further aspect of the invention, the dust-collecting pipe for a vacuum cleaner may include a coupling part detachably coupled to a front end of a telescopic pipe or a front end of a control handle of the vacuum cleaner; an extension integrally extending from the coupling part; and a suction part longitudinally extending from one end of the extension to a predetermined length. The suction part may include a slot-shaped dust-collecting port formed in a central area of one side of the suction part, the dust-collecting port sucking in dust or particulate particles; contact protrusions extending from both sides of the dust-collecting port; and a plurality of indents formed between the contact protrusions and arrayed along a length of the contact protrusions at predetermined intervals such that the dust-collecting port communicates with an outside through the indents when the contact protrusions are in contact with a flat surface.

The suction port may have a height ranging from 15 mm to 25 mm, a length ranging from 30 mm to 35 mm. The extension may have a length ranging from 60 cm to 90 cm.

According to embodiments of the invention, the dust-collecting pipe for a vacuum cleaner can easily remove dust from an area to be cleaned such as the top surface of a wardrobe or an area under the wardrobe.

Furthermore, dust or particulate matters can be efficiently and easily removed from a heat radiator of a refrigerator.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 3A:
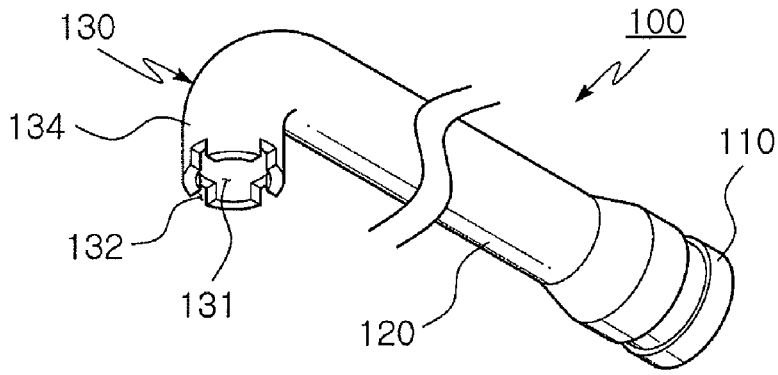
FIG. 3 (*a*)-(*c*) are perspective views illustrating variations of the dust-collecting pipe shown in FIG. 2, in which FIG. 3 (*a*) shows indents formed in a dust-collecting port, FIG. 3 (*b*) shows a stepped portion in the dust-collecting port shown in FIG. 3 (*a*), and FIG. 3 (*c*) shows a rubber tip coupled to the dust-collecting port shown in FIG. 3 (*b*)
Figure 3B:
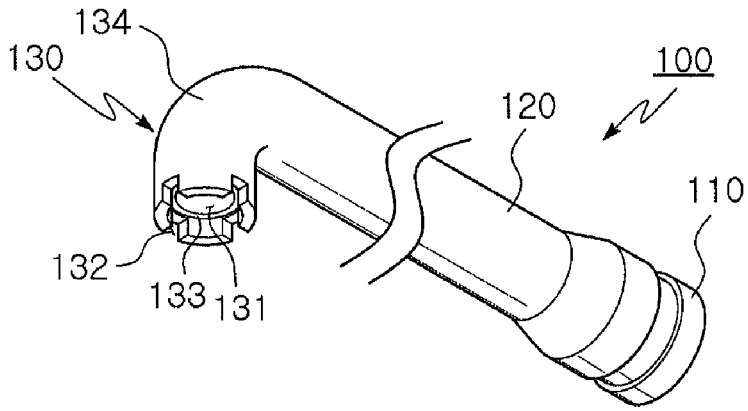
Figure 3C:
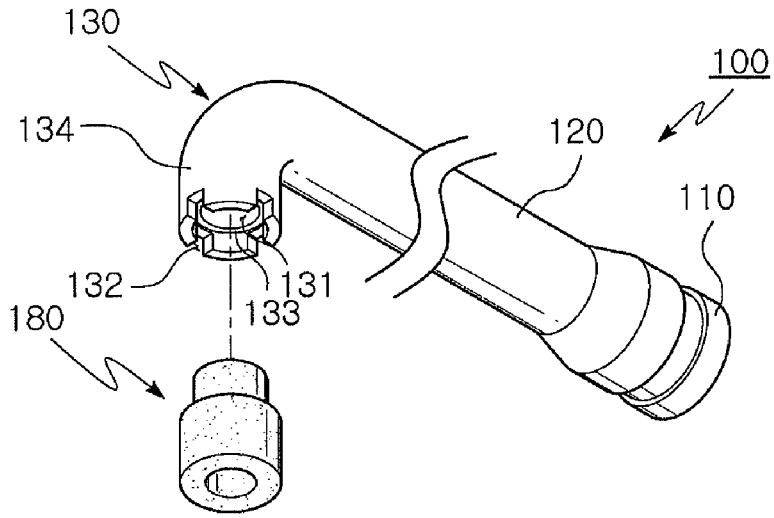
Figure 4A:
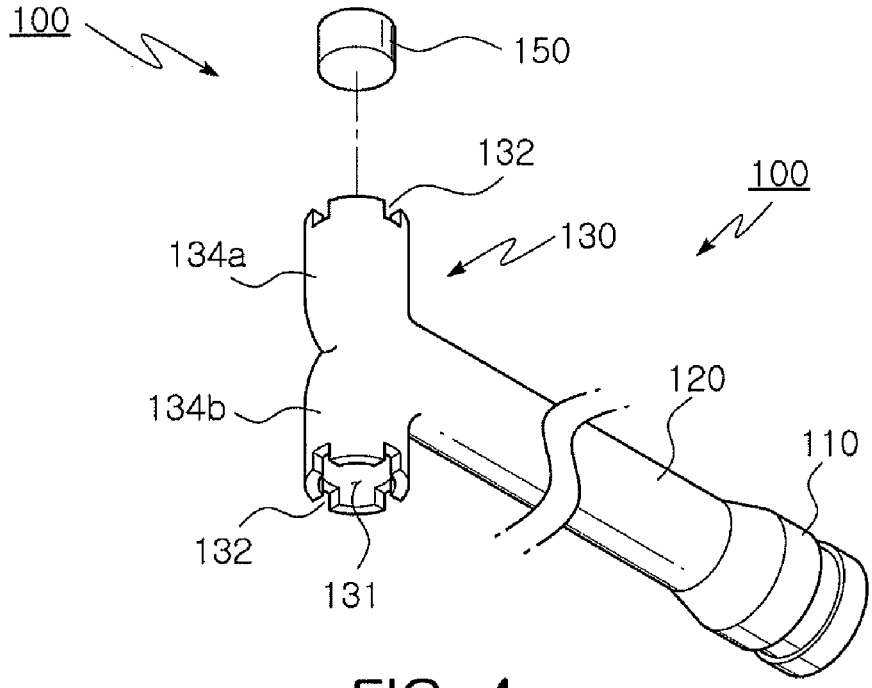
FIG. 4 (*a*)-(*b*) are perspective views illustrating a dust-collecting pipe for a vacuum cleaner in accordance with a second exemplary embodiment of the invention, in which FIG. 4 (*a*) shows the dust-collecting pipe without a brush or rubber tip, and FIG. 4 (*b*) shows the dust-collecting pipe with a rubber tip.
Figure 4B:
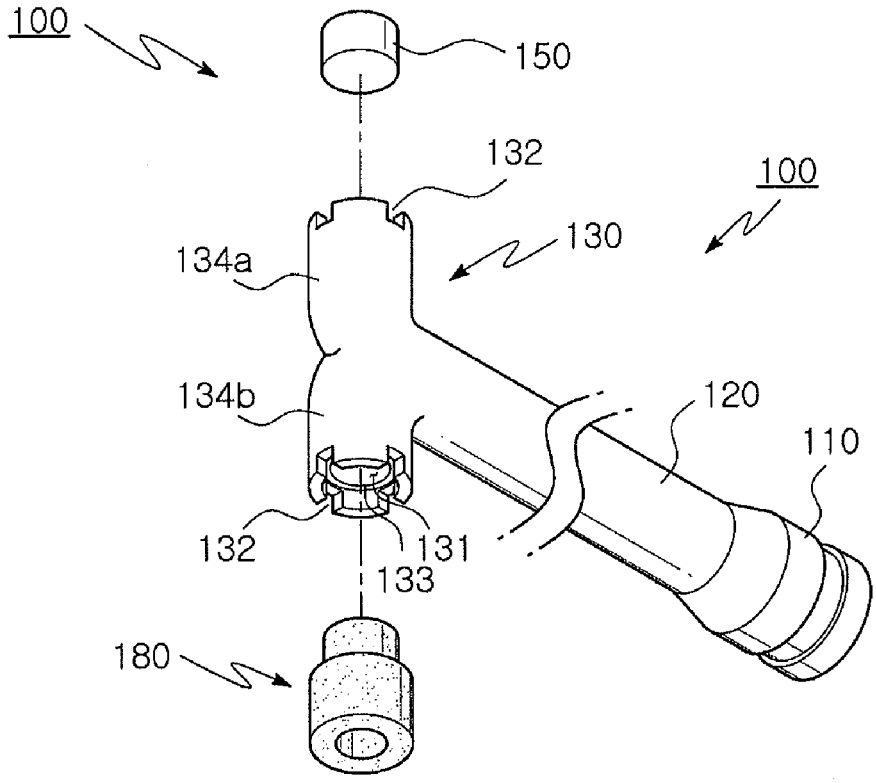
Figure 5:
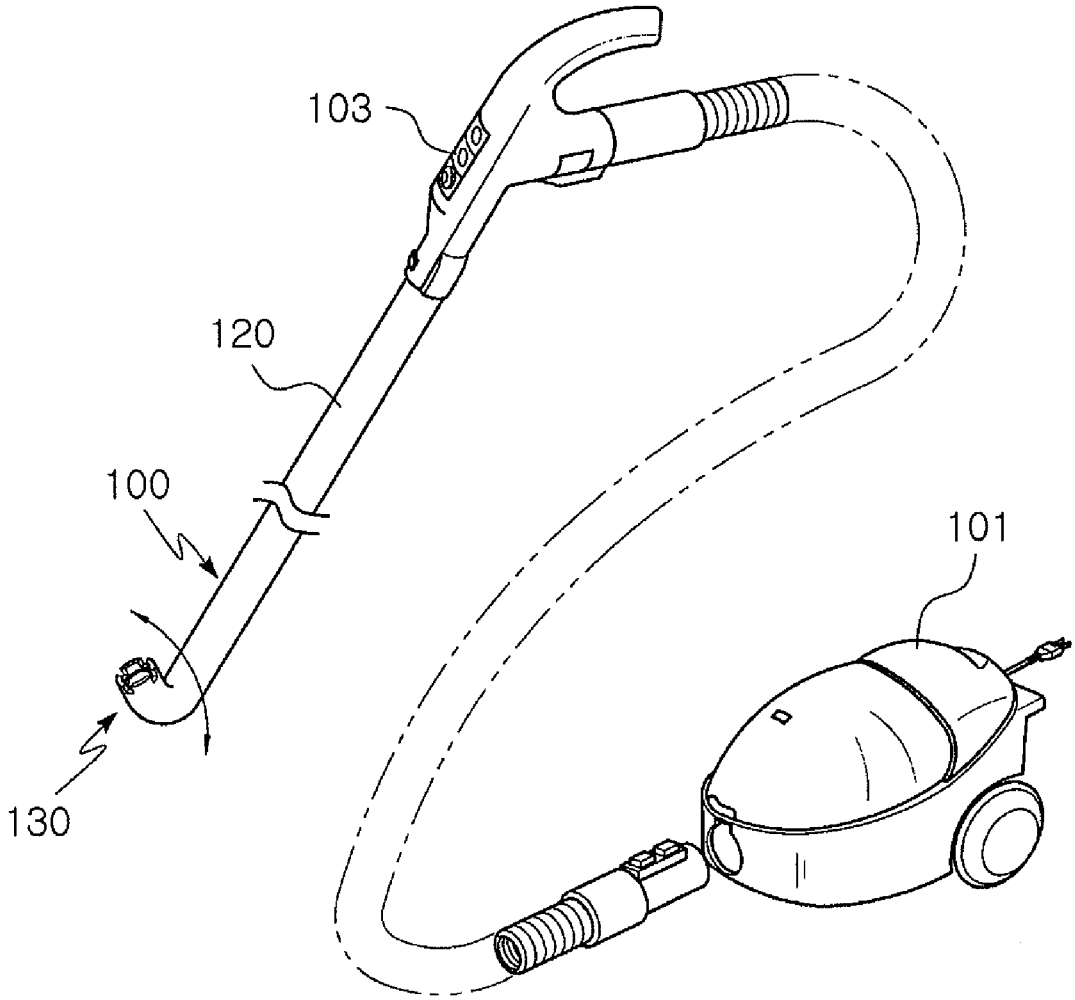
FIG. 5 is a schematic configuration view illustrating the use of the dust-collecting pipe shown in FIG. 2 or 4.
Figure 6:
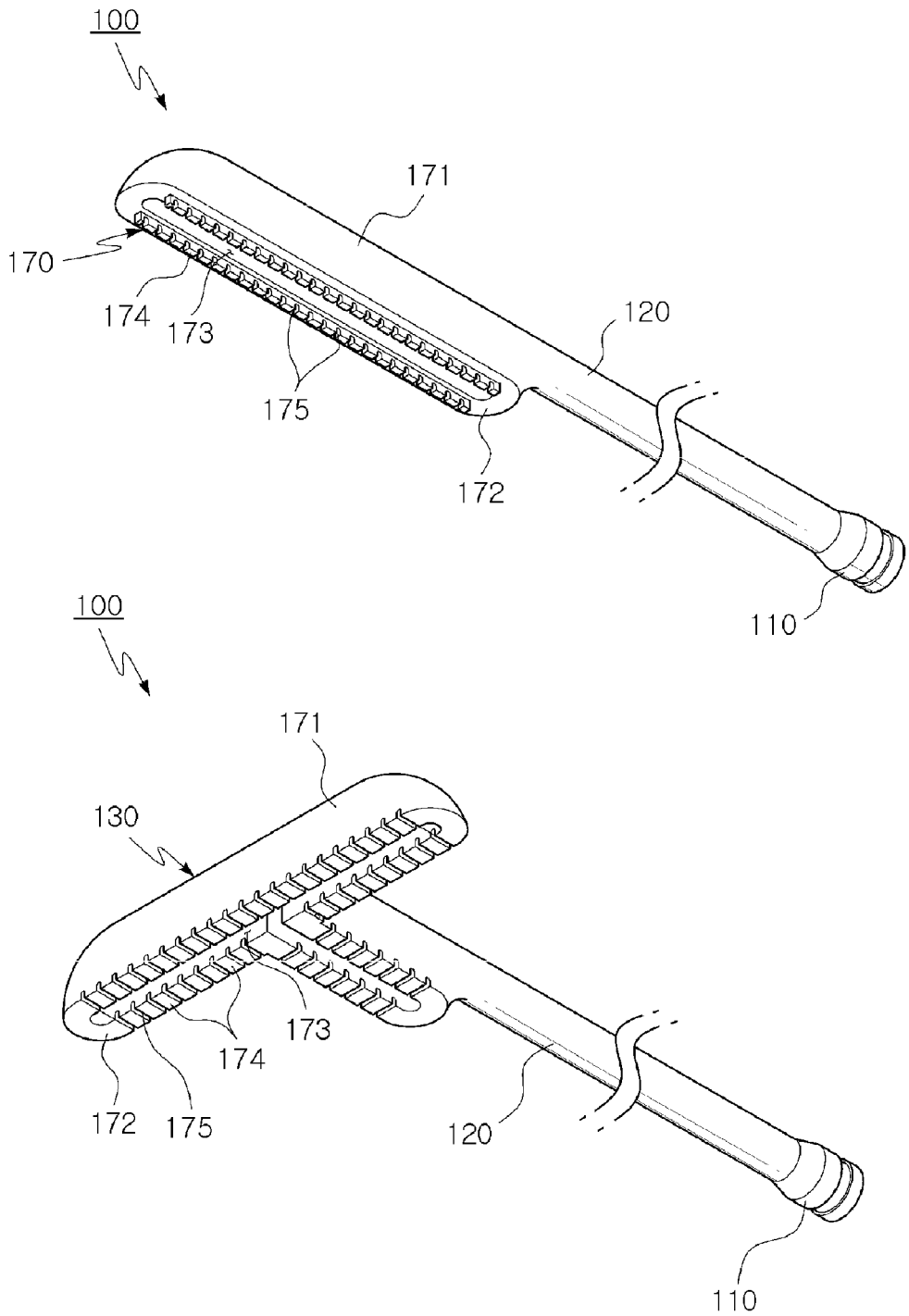
FIG. 6 is perspective views illustrating a dust-collecting pipe for a vacuum cleaner in accordance with a third exemplary embodiment of the invention.
Figure 7:
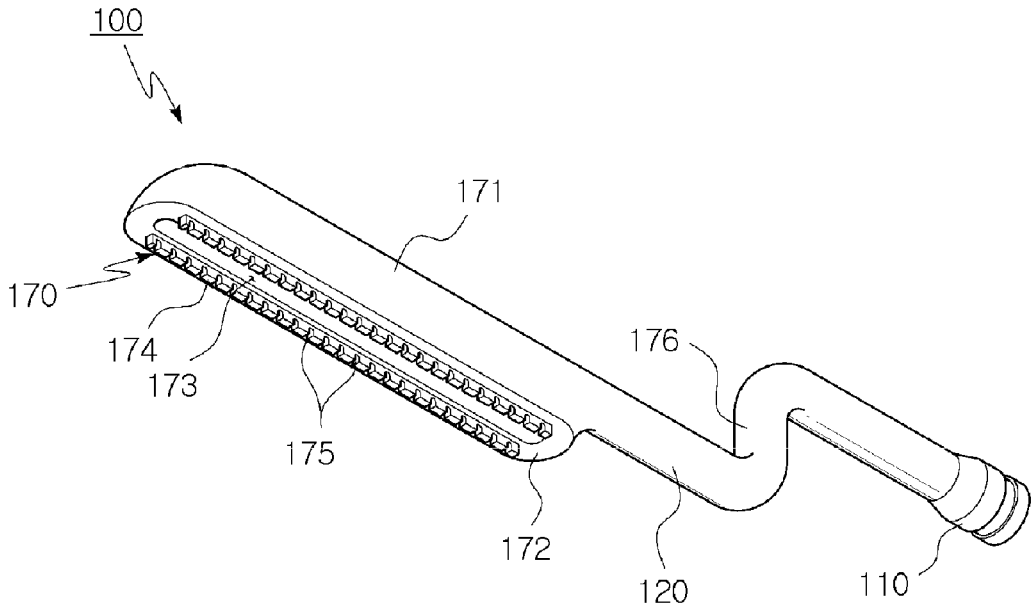
FIG. 7 is perspective views illustrating variations of the extension of the dust-collecting pipe shown in FIG. 6.
Figure 7:
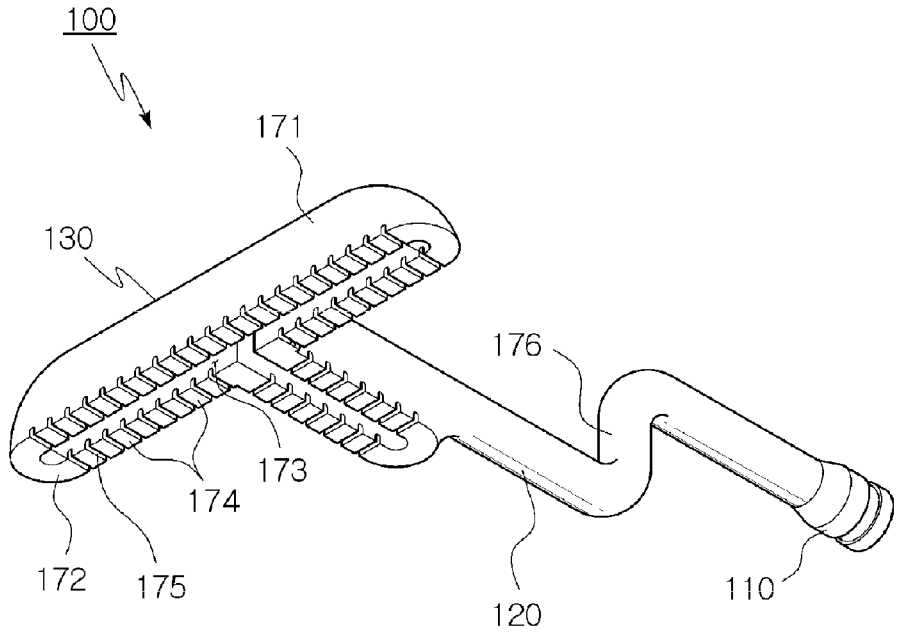
Figure 8:
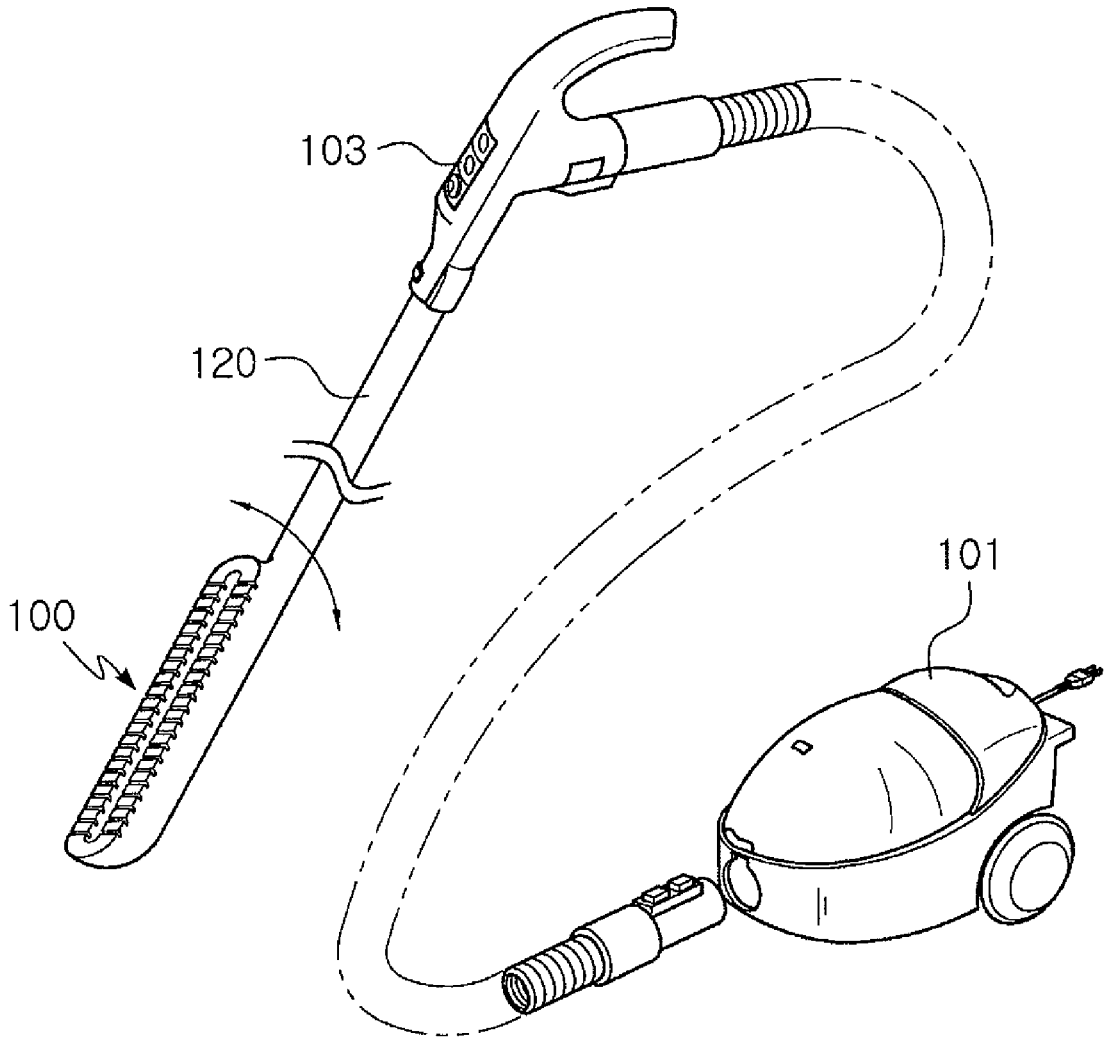
FIG. 8 is a schematic configuration view illustrating the use of the dust-collecting pipe shown in FIG. 6.

In the accompanying drawings, FIG. 2 is perspective views illustrating a dust-collecting pipe for a vacuum cleaner in accordance with one exemplary embodiment of the invention, in which FIG. 2 (*a*) shows a brush connected to the dust-collecting pipe, FIG. 2 (*b*) shows a rubber tip connected to the dust-collecting pipe, and FIG. 2 (*c*) shows a variation of the rubber tip, 2 (*d*) shows a variation of the rubber tip. FIG. 3 is perspective views illustrating variations of the dust-collecting pipe shown in FIG. 2, in which FIG. 3 (*a*) shows indents formed in a dust-collecting port, FIG. 3 (*b*) shows a stepped portion in the dust-collecting port shown in FIG. 3 (*a*), and FIG. 3 (*c*) shows a rubber tip coupled to the dust-collecting port shown in FIG. 3 (*b*). FIG. 4 is perspective views illustrating a dust-collecting pipe for a vacuum cleaner in accordance with a second exemplary embodiment of the invention, in which FIG. 4 (*a*) shows the dust-collecting pipe without a brush or a rubber tip, and FIG. 4 (*b*) shows the dust-collecting pipe with a rubber tip. FIG. 5 is a schematic configuration view illustrating the use of the dust-collecting pipe shown in FIG. 2 or 4. FIG. 6 is perspective views illustrating a dust-collecting pipe for a vacuum cleaner in accordance with a third exemplary embodiment of the invention. FIG. 7 is perspective views illustrating variations of the extension of the dust-collecting pipe shown in FIG. 6. FIG. 8 is a schematic configuration view illustrating the use of the dust-collecting pipe shown in FIG. 6.

The dust-collecting pipe for a vacuum cleaner of the invention is a device detachably coupled to the front end of a telescopic pipe or a control handle connected to the body of the vacuum cleaner. The dust-collecting pipe for a vacuum cleaner of the invention is very useful for removing dust or particulate matters from an area to be cleaned such as a heat radiator, the top surface of a wardrobe, or an area under a wardrobe.

In the accompanying drawings, the same reference numerals or signs are used to designate like or equivalent elements.

First Embodiment

Referring to FIG. 2, the dust-collecting pipe for a vacuum cleaner 100 in accordance with the first embodiment of the invention includes a coupling part 110, an extension 120, and a suction part 130.

Figure 1:
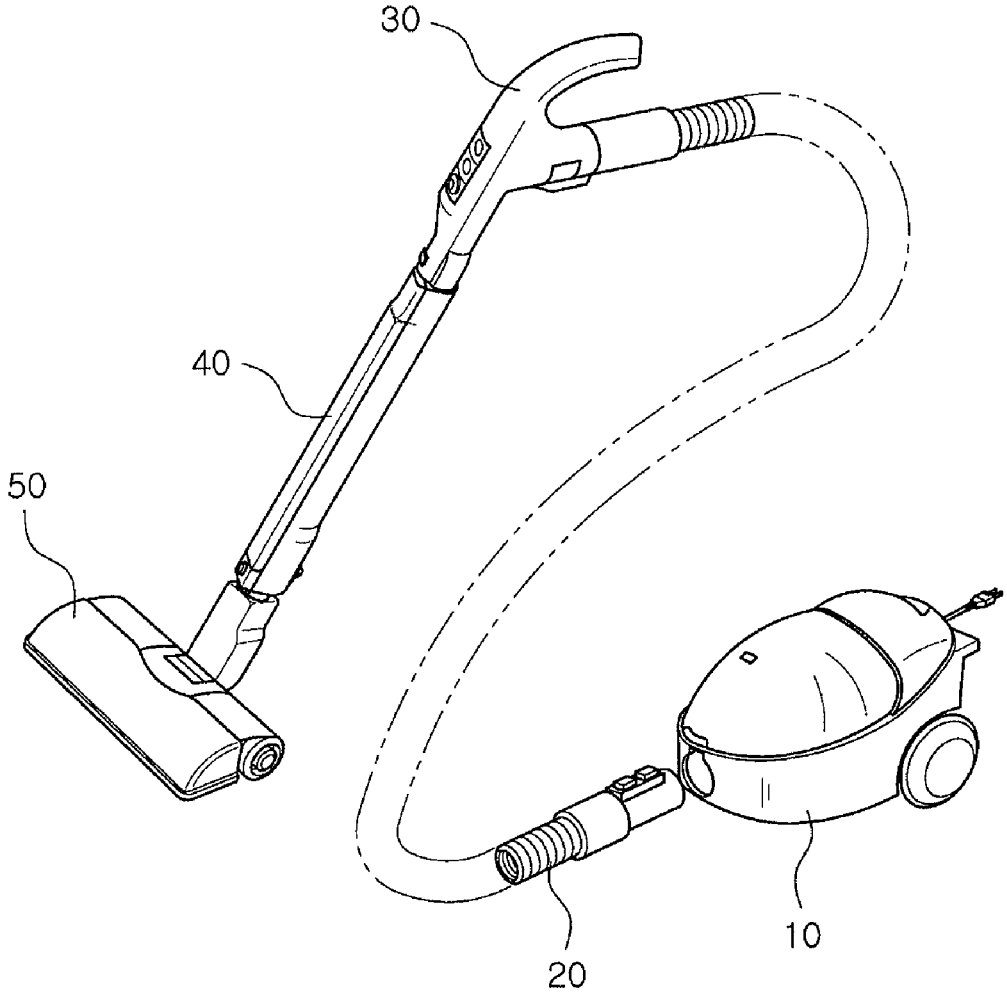
Prior art FIG. 1
FIG. 1 is a schematic configuration view illustrating a conventional vacuum cleaner.
Figure 2A:
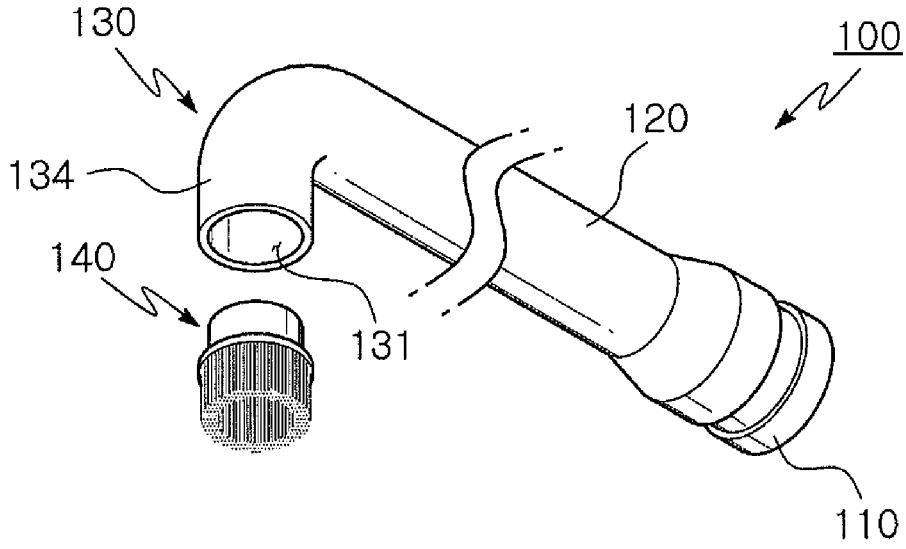
FIG. 2 (*a*)-(*d*) are perspective views illustrating a dust-collecting pipe for a vacuum cleaner in accordance with a first exemplary embodiment of the invention, in which FIG. 2 (*a*) shows a brush connected to the dust-collecting pipe, FIG. 2 (*b*) shows a rubber tip connected to the dust-collecting pipe, and FIG. 2 (*c*) shows a variation of the rubber tip.
Figure 2B:
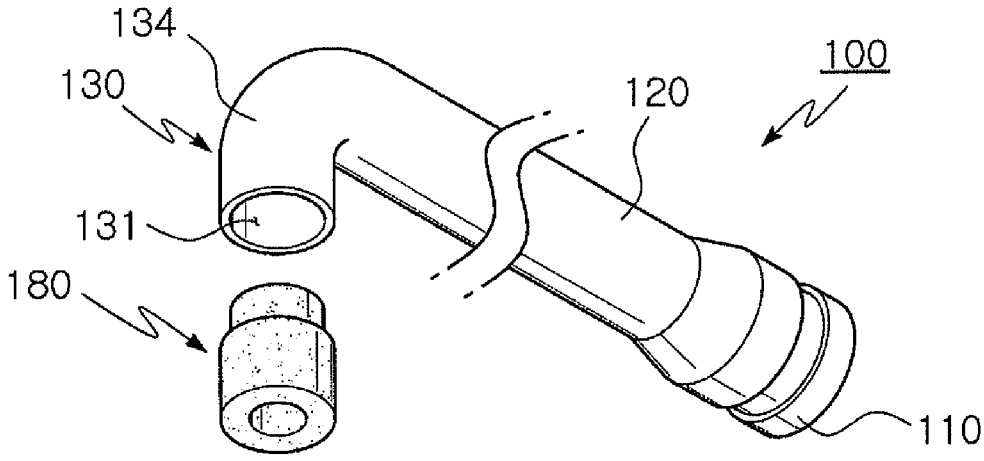
Figure 2C:
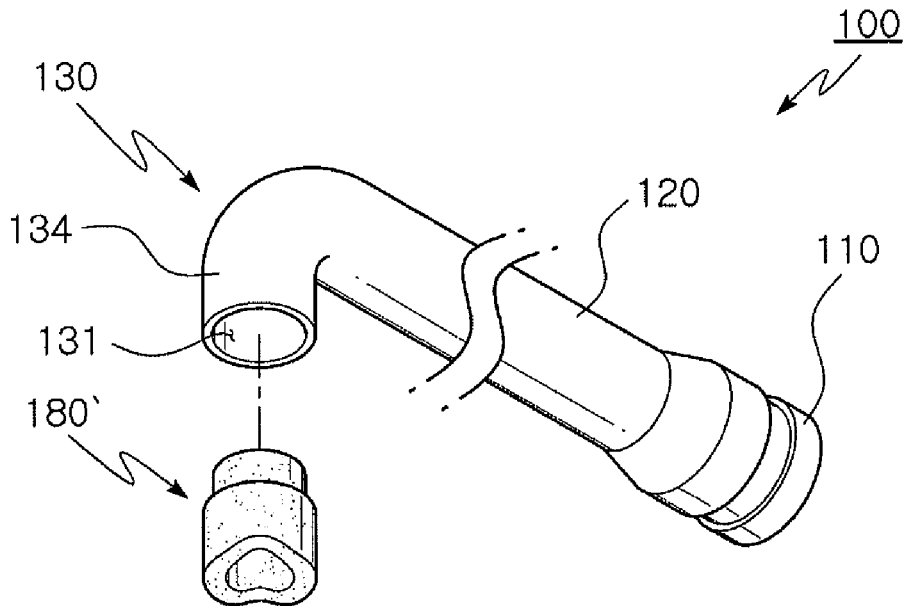
Figure 2D:
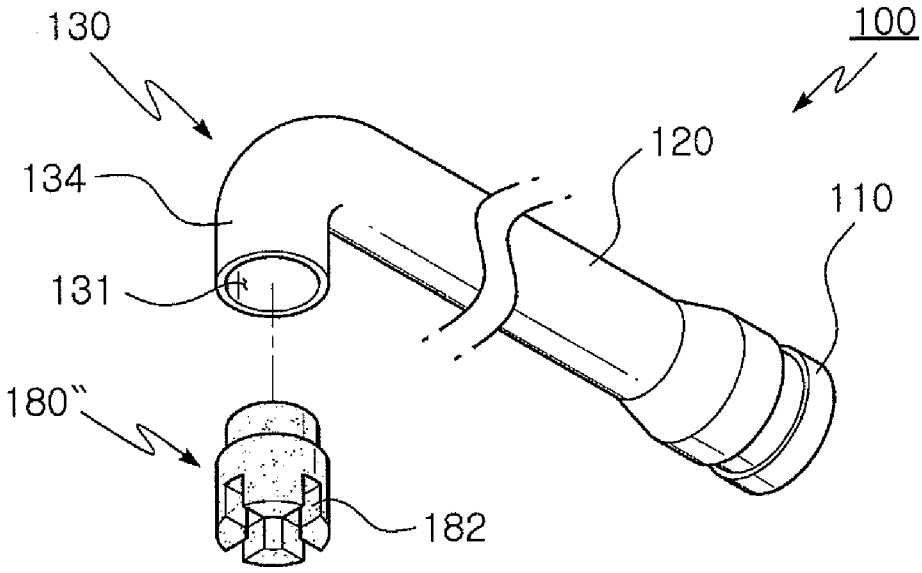

The coupling part 110 of the dust-collecting pipe 100 is coupled to the front end of a telescopic pipe 40 of a vacuum cleaner body 10 (see FIG. 1) or the front end of a control handle 103 (see FIG. 5). Thus, the dust-collecting pipe 100 can be attached to or detached from the telescopic pipe or the control handle by the coupling part 110.

The extension 120 is a part integrally extending from the coupling part 110, and the length of the extension 120 can preferably be in the range approximately from 60 cm to 90 cm. Unlike the conventional dust-collecting pipe, the extension 120 is elongated in length. As a result, an area (e.g., a heat radiator of an electric appliance such as a refrigerator), which is not or poorly cleaned by the conventional dust-collecting pipe due to an inadequate length, can be efficiently cleaned.

A large amount of dust (e.g., at a thickness of about 1 to 1.5 cm) may accumulate on top of the heat radiator of the refrigerator as the most commonly used model is changing from the vertical one-story type to the multi-story horizontal type. However, there are no conventional means for cleaning this area. If the dust accumulating on the heat radiator is not removed, the heat efficiency of the refrigerator may be reduced to half or less than at the time of delivery. In addition, leakage current may flow through dust, thereby causing a fire hazard.

Accordingly, the elongated dust-collecting pipe of the invention can realize technical features that can clean an area that is not cleaned by the conventional dust-collecting pipe for a vacuum cleaner.

The suction part 130 of the dust-collecting pipe 100 in accordance with one exemplary embodiment of the invention integrally extends from one end of the extension 120. In the suction part 130, a bent portion 134 is angled in one direction from one end of the extension 120 and defines a dust-collecting port 131 therein. The term dust-collecting port is also referred to as a suction port. The dust-collecting port 131 sucks in dust or particulate matters towards the vacuum cleaner body 101.

As shown in FIG. 3, the bent portion 134 can have a plurality of indents 132 formed along the circumference of the terminal end thereof. The indents 132 are recessed into the bent portion 134 to a predetermined depth such that the dust-collecting port 131 communicates with the outside through the indents 132 when the terminal end of the bent portion 134 is in contact with the flat surface. That is, the indents 132 allow only part of the terminal end of the bent portion 134 to contact the flat surface, thereby facilitating movement of the dust-collecting pipe 100. Without this configuration, the dust-collecting pipe 100 may stick to the flat surface by an absorbing force at the time of cleaning.

Dust or particulate matters are firstly sucked in through the indents 132 of the bent portion 134, and are then sucked in through the dust-collecting port 131. In sequence, dust or particulate matters are introduced into the vacuum cleaner body 101 (see FIG. 5).

In addition, as shown in FIG. 3 (*b*), a stepped portion 133 can be formed inside the dust-collecting port 131. The stepped portion 133 is formed by reducing the inner diameter of a predetermined portion to be smaller than those of the other portions of the dust-collecting port 131. The reduction in the diameter enhances an absorbing force. As shown in FIG. 2, the dust-collecting port 131 can be provided without a stepped portion.

As shown in FIG. 2 (*a*), a brush 140 can be detachably coupled to the terminal end of the bent portion 134 where the dust-collecting port 131 is formed. This configuration of the brush 140 facilitates cleaning of a uneven surface, an area that does not form a flat surface, or a surface on which a scratch may be formed by the dust-collecting pipe.

In addition, a rubber tip 180 can be provided in place of the brush 140. As shown in FIG. 2 (*b*), the rubber tip 180 can be detachably coupled to the terminal end of the bent portion 134 where the dust-collecting port 131 is formed. When the rubber tip 180 is used, cleaning efficiency can be enhanced based on an excellent absorbing force sucking in dust through the dust-collecting port 131.

As shown in FIG. 2 (*c*), a rubber tip 180' having a waved uneven bottom can be used for partial or linear contact with a surface to be cleaned. This configuration can prevent the bottom of the rubber tip from sticking to the surface to be cleaned by an absorbing force.

Like the configuration shown in FIG. 2 (*d*), the rubber tip 180" can also have a plurality of indents 182 formed along the circumference of the terminal end. The indents 182 allow only part of the terminal end of rubber tip 180" to contact the flat surface, thereby facilitating movement of the dust-collecting pipe 100. Without this configuration, the dust-collecting pipe 100 may stick to the flat surface by an absorbing force at the time of cleaning.

Second Embodiment

Referring to FIG. 4, the dust-collecting pipe 100 in accordance with the second embodiment of the invention includes a coupling part 110, an extension 120, and a suction part 130. The coupling part 110 is coupled to the front end of a telescopic pipe 40 of a vacuum cleaner body 10 (see FIG. 1) or the front end of a control handle 103 (see FIG. 5). Thus, the dust-collecting pipe 100 can be attached to or detached from the telescopic pipe or the control handle by the coupling part 110. The extension 120 is a part integrally extending from the coupling part 110, and the length of the extension 120 can preferably be in the range approximately from 60 cm to 90 cm.

The suction part 130 of the dust-collecting pipe 100 of this embodiment has a pair of bent portions 134*a* and 134*b* branched off from one end of the extension 120 at predetermined angles. The bent portions 134*a* and 134*b* extend in opposite directions from each other. Each of the bent portions 134*a* and 134*b* defines a dust-collecting port 131 inside the terminal end thereof so as to suck in dust and particulate matters.

The bent portion 134*a* or 134*b* can have a plurality of indents 132 formed along the circumference of the terminal end thereof. The indents 132 are recessed into the bent portion 134 to a predetermined depth such that the dust-collecting port 131 communicates with the outside when the terminal end of the bent portion 134*a* or 134*b* is in contact with the flat surface. That is, the indents 132 allow only part of the terminal end of the bent portion 134*a* or 134*b* to contact the flat surface, thereby facilitating movement of the dust-collecting pipe 100. Without this configuration, the dust-collecting pipe 100 may stick to the flat surface by an absorbing force at the time of cleaning.

Dust or particulate matters are firstly sucked in through the indents 132 of the bent portion 134*a* or 134*b*, and are then sucked in through the dust-collecting port 131. In sequence, dust or particulate matters are introduced into the vacuum cleaner body 101 (see FIG. 5).

A closer 150 can be added to the dust-collecting port 131 of one of the bent portions 134*a* and 134*b* to selectively close the dust-collecting port 131. The closer 150 closes one of the two dust-collecting ports 131, which is not used, thereby enhancing the absorbing force of the open dust-collecting port 131.

In addition, as shown in FIG. 4 (*b*), a stepped portion 133 can be formed inside the dust-collecting port 131. The stepped portion 133 is formed by reducing the inner diameter of a predetermined portion to be smaller than those of the other portions of the dust-collecting port 131. The reduction in the diameter enhances the absorbing force. Like the configuration shown in FIG. 2 (*a*), a brush 140 can be detachably coupled to the terminal end of the bent portion 134*a* or 134*b* where the dust-collecting port 131 is formed. Of course, as shown in FIG. 4 (*b*) a rubber tip 180 can also be detachably coupled to the terminal end of the bent portion 134*a* or 134*b* where the dust-collecting port 131 is formed.

When the brush 140 is provided (i.e., when the rubber tip 180 shown in FIG. 4 (*b*) is replaced by the brush 140), a uneven surface, an area that does not form a flat surface, or a surface on which a scratch may be formed by the dust-collecting pipe, can be easily cleaned using the brush 140.

As shown in FIG. 4 (*b*), when the rubber tip 180 is provided in the terminal end of the bent portion 134 where the dust-collecting portion 131 is formed, cleaning efficiency can be enhanced based on an excellent absorbing force sucking in dust through the dust-collecting port 131.

Like the configuration shown in FIG. 2 (*c*), the rubber tip 180' having a waved uneven bottom can also be used for partial or linear contact with a surface to be cleaned. This configuration can prevent the bottom of the rubber tip from sticking to the surface to be cleaned.

Like the configuration shown in FIG. 2 (*d*), the rubber tip 180" can also have a plurality of indents 182 formed along the circumference of the terminal end. The indents 182 allow only part of the terminal end of rubber tip 180" to contact the flat surface, thereby facilitating movement of the dust-collecting pipe 100. Without this configuration, the dust-collecting pipe 100 may stick to the flat surface by an absorbing force at the time of cleaning.

The dust-collecting port 131 of the dust-collecting pipe for a vacuum cleaner 100 in accordance with the first or second embodiments of the invention can have various shapes, which may include but not limited to a circle, a quadrangle, pentagon, hexagon, and so on. However, they are not intended to limit the invention to the precise forms disclosed, and many modifications and variations are apparent to a person of ordinary skill in the art in light of the above teachings.

If the dust-collecting port 131 has a circular shape, the diameter can preferably be in the range from 1 mm to 20 mm. If the dust-collecting port 131 has a polygonal shape, the diagonal line can preferably be in the range from 1 mm to 20 mm. However, they are not intended to limit the invention to the dimensions disclosed, and many different dimensions are apparent to a person of ordinary skill in the art in light of the above teachings.

FIG. 5 is a schematic configuration view illustrating the use of the dust-collecting pipe in accordance with the first or second embodiment of the invention, which is coupled to the body of the vacuum cleaner. The dust-collecting pipe 100 can be connected to the control handle 103. It should be understood, however, that the dust-collecting pipe 100 can be connected not only to the control handle 103 but also to the telescopic pipe, which is connected to the other end of the control handle 103, according to places where the vacuum clear is used.

Third Embodiment

Referring to FIG. 6, the dust-collecting pipe 100 in accordance with the third embodiment of the invention includes a coupling part 110, an extension 120, and a suction part 130.

The coupling part 110 of the dust-collecting pipe 100 is coupled to the front end of a telescopic pipe 40 of a vacuum cleaner body 10 (see FIG. 1) or the front end of a control handle 103 (see FIG. 8). Thus, the dust-collecting pipe 100 can be attached to or detached from the telescopic pipe or the control handle by the coupling part 110.

The extension 120 is a part integrally extending from the coupling part 110, and the length of the extension 120 can preferably be in the range approximately from 60 cm to 90 cm. As shown in FIG. 7, the extension 120 can have a stepped portion 176 in the middle of the length thereof. The stepped portion 176 is formed by bending an intermediate section of the extension 120.

Since the stepped portion 176 is provided in the middle of the length of the elongated extension 120 with different heights at opposite ends, the bottom surface of the suction part 130 can remain parallel to the surface, which is being cleaned.

Although the stepped portion 176 is illustrated as being bent at right angles, it can be bent at different angles such that opposite end portions of the extension 120 are inclined with respect to each other.

The suction part 130 longitudinally extends from one end of the extension 120, with a planar surface 172 on one side and a curved surface 172 on the other side. A slot-shaped dust-collecting port 173, which sucks in dust or particulate particles, is formed in the central area of the planar surface 172 of the suction part 130. Referring to the upper part of FIG. 6, contact protrusions 174 are formed on both sides of the slot-shaped dust-collecting port 173 along the longitudinal direction of the dust-collecting port 173, and a plurality of indents 175 are formed between the contact protrusions 174 at predetermined intervals such that the dust-collecting port communicates 173 communicates with the outside through the indents 175 when the contact protrusions 174 are in contact with the flat surface.

The suction port 130 can preferably have a height in the range from 15 mm to 25 mm and a length in the range from 30 mm to 35 mm. More preferably, the height can be 20 mm and the length can be 30 mm. With this configuration, an area under a wardrobe can be easily cleaned. While the suction port has been described as having the height from 15 to 25 mm and the length from 30 to 35 mm, they are not intended to limit the invention to the precise forms disclosed. It should be understood, however, that many modifications and variations are apparent to a person of ordinary skill in the art in light of the above teachings.

The contact protrusions 174 can prevent the dust-collecting pipe 100 from sticking to the flat surface by an absorbing force, thereby facilitating movement of the dust-collecting pipe 100 at the time of cleaning.

Dust or particulate matters are firstly sucked in through the indents 175 of the contact protrusions 174, and are then sucked in through the dust-collecting port 133. In sequence, dust or particulate matters are introduced into the vacuum cleaner body 101 (see FIG. 8).

Referring to the lower part of FIG. 6, in the suction part 130 of the dust-collecting pipe for a vacuum cleaner 100 in accordance with the third embodiment of the invention, the indents 175 formed on both sides of the dust-collecting port 173 are recessed inwards from the planar surface 172. With this configuration, the contact protrusions 174 as shown in the upper part of FIG. 6 can be omitted.

The dust-collecting pipe 100 of this embodiment as described above realizes technical features that can be efficiently used to remove dust or the like from the top surface of a wardrobe or an area under the wardrobe.

FIG. 8 is a schematic configuration view illustrating the use of the dust-collecting pipe of this embodiment, which is coupled to the body of vacuum cleaner. The dust-collecting pipe 100 can be connected to the control handle 103. It should be understood, however, that the dust-collecting pipe 100 can be connected not only to the control handle 103 but also to the telescopic pipe, which is connected to the other end of the control handle 103, according to places where the vacuum clear is used.

The foregoing descriptions of specific exemplary embodiments of the present invention have been presented for purposes of illustration and description. They are not intended to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A dust-collecting pipe for a vacuum cleaner comprising:

a coupling part detachably coupled to a front end of a telescopic pipe or a front end of a control handle of the vacuum cleaner;

an extension integrally extending from the coupling part; and a suction part having a bent portion angled in one direction from one end of the extension and a hollow dust-collecting port formed in a terminal end of the suction part, wherein the bent portion has a plurality of indents formed along a circumference of a terminal end thereof, the indents recessed to a predetermined depth toward the dust-collecting port such that the dust-collecting port communicates with an outside through the indents when the terminal end of the bent portion is in contact with a flat surface; and a brush or a rubber tip detachably coupled to the dust-collecting port of the suction part.

2. The dust-collecting pipe in accordance with claim 1, wherein the rubber tip has a waved uneven bottom.

3. The dust-collecting pipe in accordance with claim 1, wherein the dust-collecting port has a stepped portion with an inner diameter smaller than those of the other portions of the dust-collecting port.

4. The dust-collecting pipe in accordance with claim 1, wherein the dust-collecting port has a circular or polygonal configuration.

5. The dust-collecting pipe in accordance with claim 4, wherein the dust-collecting port has a diameter ranging from 1 mm to 20 mm.

6. The dust-collecting pipe in accordance with claim 1, wherein the extension has a length ranging from 60 cm to 90 cm.

7. The dust-collecting pipe of claim 1, wherein terminal end of the suction part is not formed by a brush such that the plurality of indents are not formed by a brush.

8. A dust-collecting pipe for a vacuum cleaner comprising:

a coupling part detachably coupled to a front end of a telescopic pipe or a front end of a control handle of the vacuum cleaner;

an extension integrally extending from the coupling part; and a suction part having a pair of bent portions branched off from one end of the extension at predetermined angles, wherein the bent portions extend in opposite directions from each other, and hollow dust-collecting ports each formed in a terminal end of a corresponding one of the suction parts, wherein the bent portion has a plurality of indents formed along a circumference of a terminal end thereof, the indents recessed to a predetermined depth toward the dust-collecting port such that the dust-collecting port communicates with an outside through the indents when the terminal end of the bent portion is in contact with a flat surface.

9. The dust-collecting pipe in accordance with claim 8, further comprising a brush or a rubber tip detachably coupled to the dust-collecting port of the suction part.

10. The dust-collecting pipe in accordance with claim 9, wherein the rubber tip has a waved uneven bottom.

11. The dust-collecting pipe in accordance with claim 8, wherein the dust-collecting port has a stepped portion with an inner diameter smaller than those of the other portions of the dust-collecting port.

12. The dust-collecting pipe in accordance with claim 8, wherein the dust-collecting port has a circular or polygonal configuration.

13. The dust-collecting pipe in accordance with claim 12, wherein the dust-collecting port has a diameter ranging from 1 mm to 20 mm.

14. The dust-collecting pipe in accordance with claim 8, wherein the extension has a length ranging from 60 cm to 90 cm.

15. The dust-collecting pipe in accordance with claim 8, further comprising a closer selectively provided in one of the dust-collecting ports to close the dust-collecting port.

16. The dust-collecting pipe of claim 8, wherein terminal end of the suction part is not formed by a brush such that the plurality of indents are not formed by a brush.

* * * * *